US007654511B2

(12) United States Patent
Nagata et al.

(10) Patent No.: US 7,654,511 B2
(45) Date of Patent: Feb. 2, 2010

(54) SHEET POST-PROCESSING APPARATUS AND IMAGE FORMATION APPARATUS PROVIDED WITH THE SAME

(75) Inventors: Jinichi Nagata, Osaka (JP); Kozo Yamaguchi, Kashihara (JP); Hideo Yoshikawa, Yamatokoriyama (JP); Shin Tsugane, Hokuto (JP); Makoto Shimura, Nirasaki (JP)

(73) Assignees: Sharp Kabushiki Kaisha, Osaka (JP); Nisca Corporation, Yamanashi (JP)

( * ) Notice: Subject to any disclaimer, the term of this patent is extended or adjusted under 35 U.S.C. 154(b) by 96 days.

(21) Appl. No.: 11/372,790

(22) Filed: Mar. 10, 2006

(65) Prior Publication Data

US 2006/0202403 A1 Sep. 14, 2006

(30) Foreign Application Priority Data

Mar. 10, 2005 (JP) ..... 2005-067278

(51) Int. Cl.
*B65H 37/04* (2006.01)

(52) U.S. Cl. ..... 270/58.11; 270/58.07; 270/58.08; 270/58.09; 270/58.12; 270/58.17

(58) Field of Classification Search ..... 270/58.07, 270/58.08, 58.09, 58.11, 58.12, 58.17
See application file for complete search history.

(56) References Cited

U.S. PATENT DOCUMENTS 6,142,461 A * 11/2000 Asao et al. ..... 270/58.09
6,371,472 B1 * 4/2002 Miyake et al. ..... 270/58.14
6,517,065 B2 * 2/2003 Miyake et al. ..... 270/58.09
6,575,446 B2 * 6/2003 Wakabayashi et al. ... 270/58.07
2004/0126163 A1 * 7/2004 Asami et al. ..... 399/410

FOREIGN PATENT DOCUMENTS

| | | |
|---|---|---|
| JP | 11180628 | 7/1999 |
| JP | 3026221 | 3/2000 |
| JP | 2003261259 | 9/2003 |

* cited by examiner

*Primary Examiner*—Gene Crawford
*Assistant Examiner*—Leslie A Nicholson, III
(74) *Attorney, Agent, or Firm*—Michaud-Kinney Group LLP

(57) ABSTRACT

An apparatus is provided with a processing tray 42 to mount sheets ejected from an image formation section, aligning means (aligning plates 61, etc.) for aligning end portions of a sheet ejected on the processing tray 42, a post-processing apparatus 43 that performs binding processing on the sheets aligned by the aligning means, and moving means (unit moving motor 60, etc.) for moving the post-processing apparatus 43 to a plurality of post-processing positions set to perform the binding processing at different binding processing target position on the sheets, and moves the sheets to a post-processing undergoing position corresponding to the post-processing position substantially in parallel with a travel direction of the post-processing apparatus 43. It is thereby possible to perform the binding processing on the ejected sheets appropriately while implementing the apparatus compact in size.

12 Claims, 10 Drawing Sheets

SHEET POST-PROCESSING APPARATUS AND IMAGE FORMATION APPARATUS PROVIDED WITH THE SAME

BACKGROUND OF THE INVENTION

1. Field of the Invention

The present invention relates to a sheet post-processing apparatus that holds sheets with images formed thereon ejected from an image formation apparatus such as a copy machine, printer and facsimile to perform binding processing, and to the image formation apparatus provided with the sheet post-processing apparatus.

2. Description of Related Art

In recent years, in image formation apparatuses that form an image on a sheet to eject, reduction in size of the image formation apparatus and increases in speed of image formation processing has proceeded, in order to respond to the needs of effectively using the space in an office and increasing the efficiency of work.

With such improvements in performance of the image formation apparatus, attachment apparatuses that receive sheets ejected from the image formation apparatus are also required to be reduced in size and have the function of sorting ejected sheets in good appearance.

For example, as a method of sorting sheets ejected from the image formation apparatus in good appearance, known in conventional attachment apparatuses is an apparatus capable of performing binding processing on sheets for each group ejected from an image formation apparatus, and sorting for each bundle without collapse of the bundle even after being delivered (For example, see Japanese Patent No. 3026221).

However, the above-mentioned conventional attachment apparatus has defects as described below. In other words, when the binding processing is performed on a corner portion of ejected sheets, the need arises of changing the position to bind depending on whether the sheets are ejected in phase-down (odd-number pages are ejected downward) or in phase-out (odd-number pages are ejected upward). However, in the conventional attachment apparatus, with the sheets fixed to a predetermined position, a stapler as binding means is moved to perform the binding processing on different corner portions of the sheets.

FIG. 10 is a schematic view showing the case where a stapler performs the binding processing in the conventional attachment apparatus. When performing the binding processing on different corner portions of fed sheets S, the stapler ST travels in the direction (directions showed by the arrows B and C in FIG. 10) perpendicular to the feeding direction of the sheets S shown by the arrow A in FIG. 10. However, the stapler ST has a predetermined width as shown in FIG. 10, and when performing the binding processing at positions in different corner portions of the sheets S, part of the stapler ST lies off the end portion of the sheets S. Therefore, it is necessary to reserve a width (shown by "L" in FIG. 10) corresponding to a travel range of the stapler ST, and a problem arises that the attachment apparatus cannot be reduced in size.

In view of the conventional defects, it is an object of the present invention to provide a sheet post-processing apparatus capable of performing binding processing appropriately on ejected sheets while implementing reduction in size of the apparatus and an image formation apparatus provided with the sheet post-processing apparatus.

SUMMARY OF THE INVENTION

In order to achieve the above-mentioned object, the present invention provides a sheet post-processing apparatus having mount means for mounting sheets ejected from an image formation apparatus, aligning means for aligning end portions of a sheet ejected on the mount means, post-processing means for performing binding processing on the sheets, aligned by the aligning means, mounted on the mount means, moving means for moving the post-processing means to a plurality of post-processing positions set to perform the binding processing at different binding processing target positions on the sheets, and sheet moving means for moving the sheets to post-processing undergoing positions corresponding to the post-processing positions substantially in parallel with a travel direction of the post-processing means.

The sheet post-processing apparatus is thus provided with the sheet moving means for moving the sheets to the post-processing undergoing positions corresponding to the post-processing positions substantially in parallel with a travel direction of the post-processing means, moves the sheets to the post-processing undergoing positions corresponding to the post-processing positions (binding processing positions) of the post-processing means, and thus is capable of reducing a travel amount of the post-processing means as compared with the conventional post-processing apparatus, and decreasing a travel range of the post-processing means. It is thereby possible to implement the sheet post-processing apparatus compact in size while performing the binding processing on ejected sheets appropriately.

By setting the plurality of post-processing positions corresponding to sizes of sheets, it is possible to suitably perform the binding processing corresponding to the size of sheets with images formed thereon in an image formation section. Further, by determining whether or not to shift sheets corresponding to the size of the sheets, it is made possible to shift only sheets with a particular size. For example, by determining sheets with a predetermined size or more as shift target sheets, it is possible to perform the post-processing on sheets with sizes less than the predetermined size without shifting the sheets. Further, sizes of shift target sheets are determined such that the binding processing is not performed at the binding processing target position when the post-processing means travels to a limit position of a travel-capable range on the shift target sheets, and it is thus possible to minimize types of sheets necessary to shift in performing the post-processing. Further, by setting the sheet shift direction at the opposite direction to the direction in which travel of the post-processing means is limited, it is possible to decrease an amount of travel of the post-processing means. Furthermore, by setting an amount of shift of sheets corresponding to the size of sheets, dimensions of the post-processing means, and a travel-capable range of the post-processing means, it is possible to appropriately perform the binding processing on sheets targeted for the binding processing corresponding to the size of sheets and the like. When the sheet moving means is used also as the aligning means, the number of parts can be decreased in the sheet post-processing apparatus, and it is thus possible to implement further reduction in size of the sheet post-processing apparatus. Further, when the apparatus is configured such that the mount means is provided with detecting means for detecting that a predetermined number of sheets are ejected, and that sheets are moved to the post-processing undergoing position by the aligning means whenever detecting ejection of a predetermined number of sheets, it is possible to hasten the timing of shifting to the binding processing operation, and perform efficient post-processing operation, as compared with the case of performing the binding processing whenever aligning processing is performed for each bundle of sheets mounted on the mount means.

According to the present invention, it is possible to provide a sheet post-processing apparatus capable of performing binding processing appropriately on ejected sheets while implementing reduction in size of the apparatus and an image formation apparatus provided with the sheet post-processing apparatus.

DETAILED DESCRIPTION OF THE PREFERRED EMBODIMENTS

An embodiment of the present invention will specifically be described below with reference to accompanying drawings.

Figure 1:
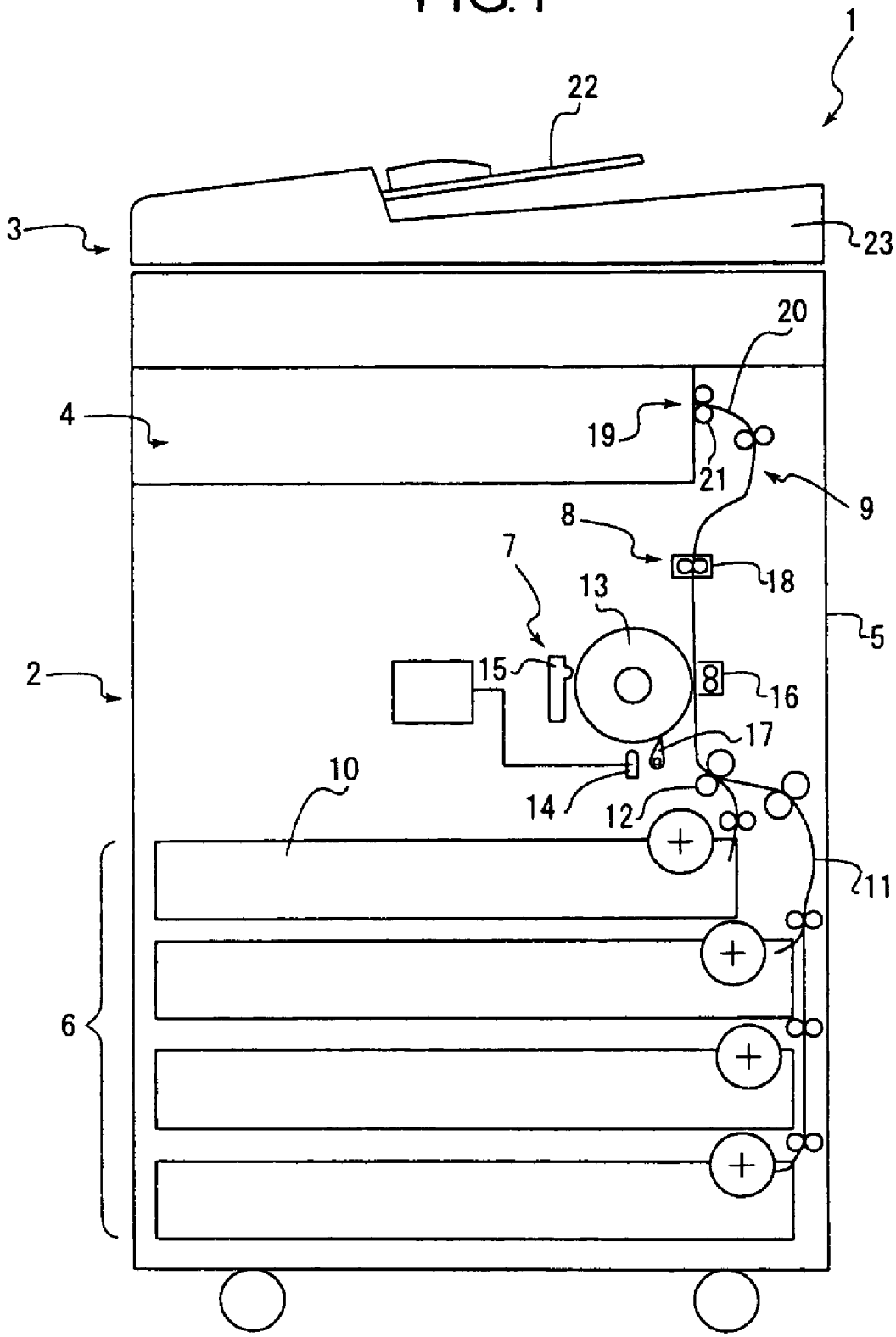
FIG. 1 is a schematic structural view of an image formation apparatus to which is applied a sheet post-processing apparatus according to one embodiment of the invention.

FIG. 1 is a schematic structural view of an image formation apparatus to which is applied a sheet post-processing apparatus according to one embodiment of the invention.

As shown in the figure, an image formation apparatus 1 is comprised of an image formation unit 2 that performs feeding processing of recording paper (hereinafter, referred to as a "sheet" as appropriate), printing processing (image formation processing), fixing processing and the like, an image reading unit 3 that performs reading processing of an original image, and a finisher unit 4 as a sheet post-processing apparatus that performs post-processing such as binding processing, punching processing and like on sheets ejected from the image formation unit 2. A construction of each unit will be described below.

The image formation unit 2 is comprised of an exterior casing 5 into which are incorporated a feeding section 6, a printing section 7, a fixing section 8 and ejecting section 9. The feeding section 6 is comprised of paper feed cassettes 10 that store sheets, and feeding rollers (not shown) that feed the sheets in the paper feed cassettes 10 successively on a sheet basis. FIG. 1 shows a plurality of paper feed cassettes 10 where sheets stored in the paper feed cassettes 10 can be fed selectively. A sheet provided from the paper feed cassette 10 is fed through a feeding path 11 formed toward the upper portion of the exterior casing 5. A register roller 12 is provided forward of the sheet fed through the feeding path 11. The printing section 7 is provided forward of the register roller 12 in the sheet feeding direction.

The printing section 7 can be configured of various printing mechanisms such as electrostatic printing, ink jet printing, silk screening and the like, and FIG. 1 shows an electrostatic printing mechanism. The printing section 7 is comprised of an electrostatic drum 13, printing head 14, developer 15, transfer charger 16 and cleaning head 17. For example, original image data read from the image reading unit 3 is sent to the printing head 14 successively. The printing head 14 emits light such as laser light to the electrostatic drum 13 corresponding to the original image data to form a latent image. The developer 15 applies toner to the latent image formed on the electrostatic drum 13, the transfer charger 16 transfers the toner on the electrostatic drum 13 to the fed sheet, and an image is thereby formed on the sheet. In addition, the timing at which a front end of the sheet is fed to a transfer region is controlled by the register roller 12. The cleaning head 17 removes the toner remaining on the electrostatic drum 13 after transfer.

The fixing section 8 is provided forward of the printing section 7 in the sheet feeding direction. The fixing section 8 has a pair of fusing rollers 18. The fusing rollers 18 heat and fix the image formed on the sheet. For example, the fusing rollers 18 apply heat with the temperature ranging from 150° C. to 200° C. to the image on the sheet to fuse the toner thereinto. The sheet subjected to the fixing processing in the fixing section 8 is sent to the ejecting section 9. The ejecting section 9 is comprised of an ejection path 20 that guides the sheet to an ejection outlet 19 formed toward the finisher unit 4, and a pair of ejecting rollers 21 provided on the ejection path 20. The sheet sent to the ejecting section 9 is fed through the ejection path 20, and ejected to the finisher unit 4 from the ejection outlet 19 by the ejecting rollers 21.

The image reading section unit 3 is disposed above the image formation unit 2, and is well known as the so-called scanner that reads an original image. The image reading unit 3 has a casing 23 with an original mount 22 formed on its upper face. A platen is provided inside the casing 23, and under the plate are provided an optical mechanism such as a source lamp, image-forming lens and the like and photoelectric conversion element. Above the platen is provided a feeder that feeds an original on the original mount 22 to the platen successively. The source lamp emits the light to the original fed onto the platen by the feeder, the reflected light is guided by the image-forming mechanism such as mirrors, lens and the like to the photoelectric conversion element such as a line sensor and the like to form an image, and the original image is thereby electrically read.

Figure 2:
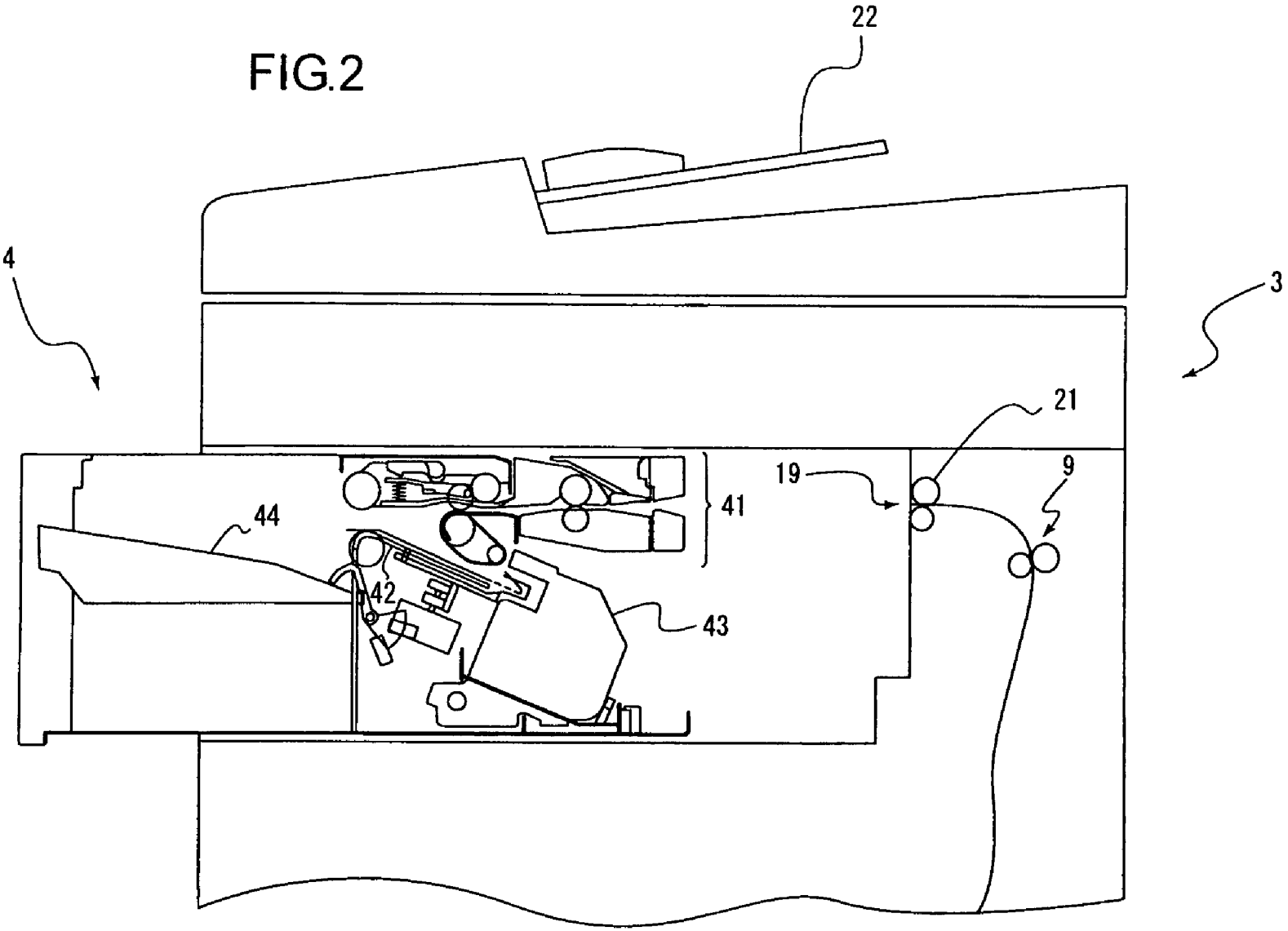
FIG. 2 is a schematic structural view of a finisher unit as the sheet post-processing apparatus of this embodiment.

The finisher unit 4 is disposed between the image formation unit 2 and image reading unit 3, and as shown in FIG. 2, installed into the image formation unit 2 while being allowed to be pulled out of the unit 2. In addition, FIG. 2 shows a state where the unit 4 is pulled out of the image formation unit 2. As shown in FIG. 2, the finisher unit 4 is provided with a sheet feeding section 41 in which is formed a feeding path that feeds a sheet fed from the image formation unit 2, a processing tray 42 that temporarily hold sheets fed by the sheet feeding section 41, a post-processing apparatus 43 that performs post-processing such as binding processing, punching processing and the like on the sheets mounted on the processing tray 42, and a collection tray 44 to which is ejected the sheets (bundle of sheets) subjected to the post-processing. In a state where the finisher unit 4 is pushed into the image formation unit 2, the feeding path formed in the sheet feeding section 41 is configured to couple to the ejection outlet 19 of the image formation unit 2.

Figure 3:
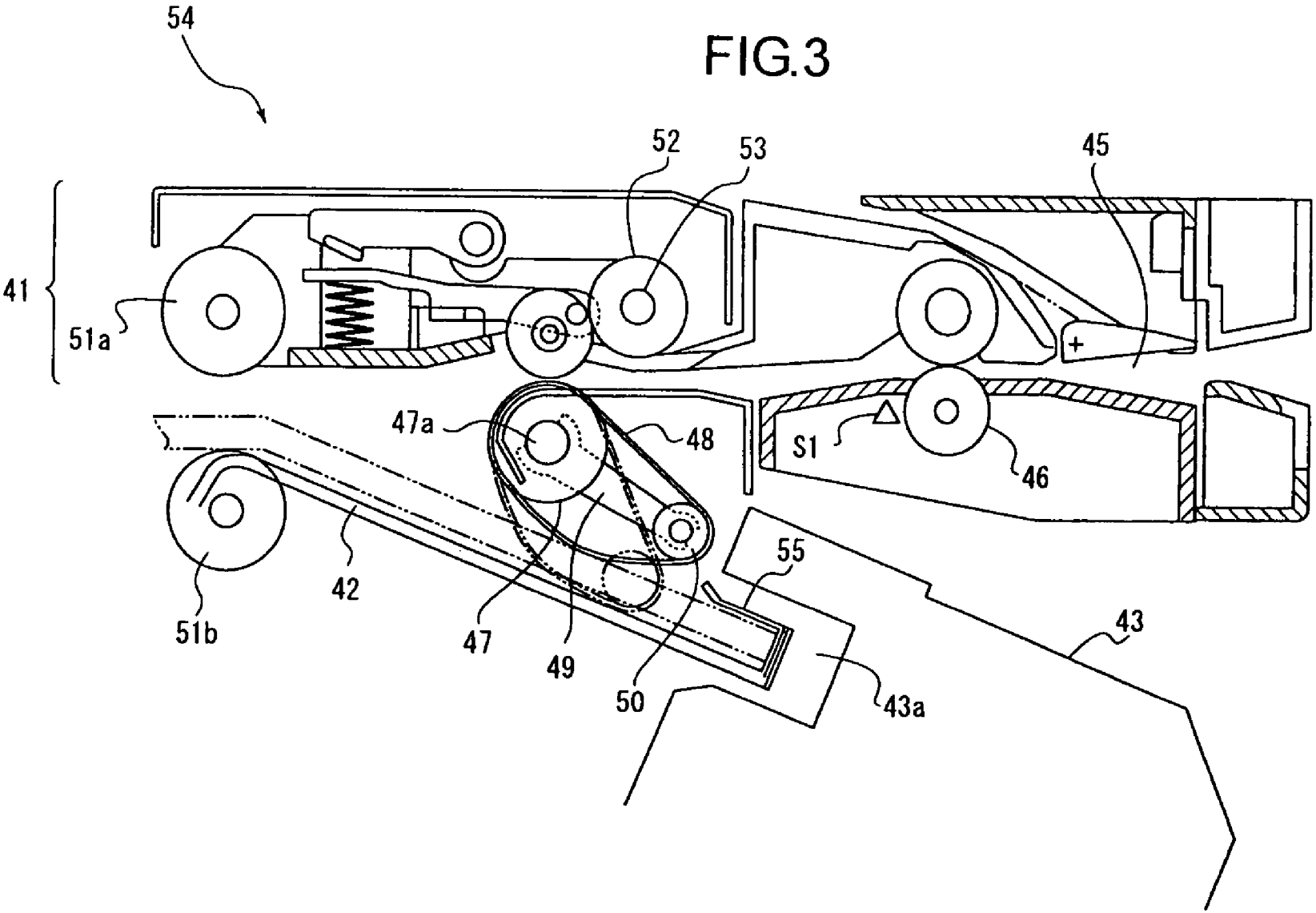
FIG. 3 is a view to explain a positional relationship between a sheet feeding section, processing tray and post-processing apparatus of the finisher unit of this embodiment.

FIG. 3 is a view to explain the positional relationship between the sheet feeding section 41, processing tray 42 and post-processing apparatus 43 in the finisher unit 4.

As shown in the figure, in the sheet feeding section 41 is formed a feeding path 45 that feeds in the horizontal direction a sheet fed from the image formation unit 2. On the feeding path 45, feeding rollers 46 and 46 are attached to exposure part of the rollers onto the feeding path 45. Slightly forward of the feeding rollers 46 in the sheet feeding direction, an entrance sensor S1 is provided to detect a front end and rear end of a fed sheet.

The feeding rollers 47 are attached in the vicinity of the termination portion of the feeding path 45, and eject the sheet to the processing tray 42. To a lower-disposed roller of the feeding rollers 47 is attached a caterpillar belt 48 that moves the sheet to positioning members described below, while feeding sheets on the processing tray 42 to the collection tray 44 side. The caterpillar belt 48 is attached at the other end to a pulley 50 attached to a support arm 49 coupled swingably to a roller axis 47*a* of the lower roller of the feeding rollers 47. The caterpillar belt 48 is supported to be able to swing about the roller axis 47*a* as a center, and comes into contact at the front end with the sheets mounted on the processing tray 42, while being revolved at the base end portion by the roller axis 47*a*.

Ejecting rollers 51 are attached at a position spaced a predetermined distance apart from the feeding rollers 47. The ejecting rollers 51 are used to eject the sheets mounted on the processing tray 42 to the collection tray 44. An upper-disposed ejecting roller 51*a* of the ejecting rollers 51 is attached to a front end portion of a sheet ejecting mechanism 54 configured to be swingable upward and downward using as a support a roller axis 53 of a driving roller 52 provided at a position spaced a predetermined distance apart from the roller 51*a*. In ejecting the sheets on the processing tray 42 to the collection tray 44, the sheet ejecting mechanism 54 moves the ejecting roller 51*a* downward to a position of the sheets. In addition, a conveyor belt (not shown) is wound around the ejecting roller 51*a* and driving roller 52 to convey the revolving force of the driving roller 52 to the ejecting roller 51*a*.

The processing tray 42 is disposed under the sheet ejecting mechanism 54. The processing tray 42 is attached while being inclined upward to the left as viewed in the figure. A sheet ejected to the processing tray 42 moves to the lower end portion on the right side as viewed in the figure by its weight and the driving force of the caterpillar belt 48. To the lower end portion of the processing tray 42 are attached a plurality of positioning members 55 along the sheet width direction (see FIG. 4). Each of the positioning members 55 has a substantially U-shape in cross section opened to the upper end portion side of the processing tray 42. The positioning members 55 come into contact with the front end of the sheet, and thereby determine a position of the sheet on the processing tray 42. In addition, FIG. 3 shows an example of sheets (a bundle of sheets) positioned by the positioning members 55 by alternate long and short dashed lines.

The post-processing apparatus 43 is disposed forward of the lower end portion of the processing tray 42. The post-processing apparatus 43 has on the upper left side a storage section 43*a* that accommodates the lower end portion of the processing tray 42, and performs post-processing at a predetermined position of the sheets on the processing tray 42. Particularly, this embodiment describes the post-processing apparatus that performs only the binding processing as the post-processing. However, the function of the post-processing apparatus 43 is not limited to the binding processing.

Figure 4:
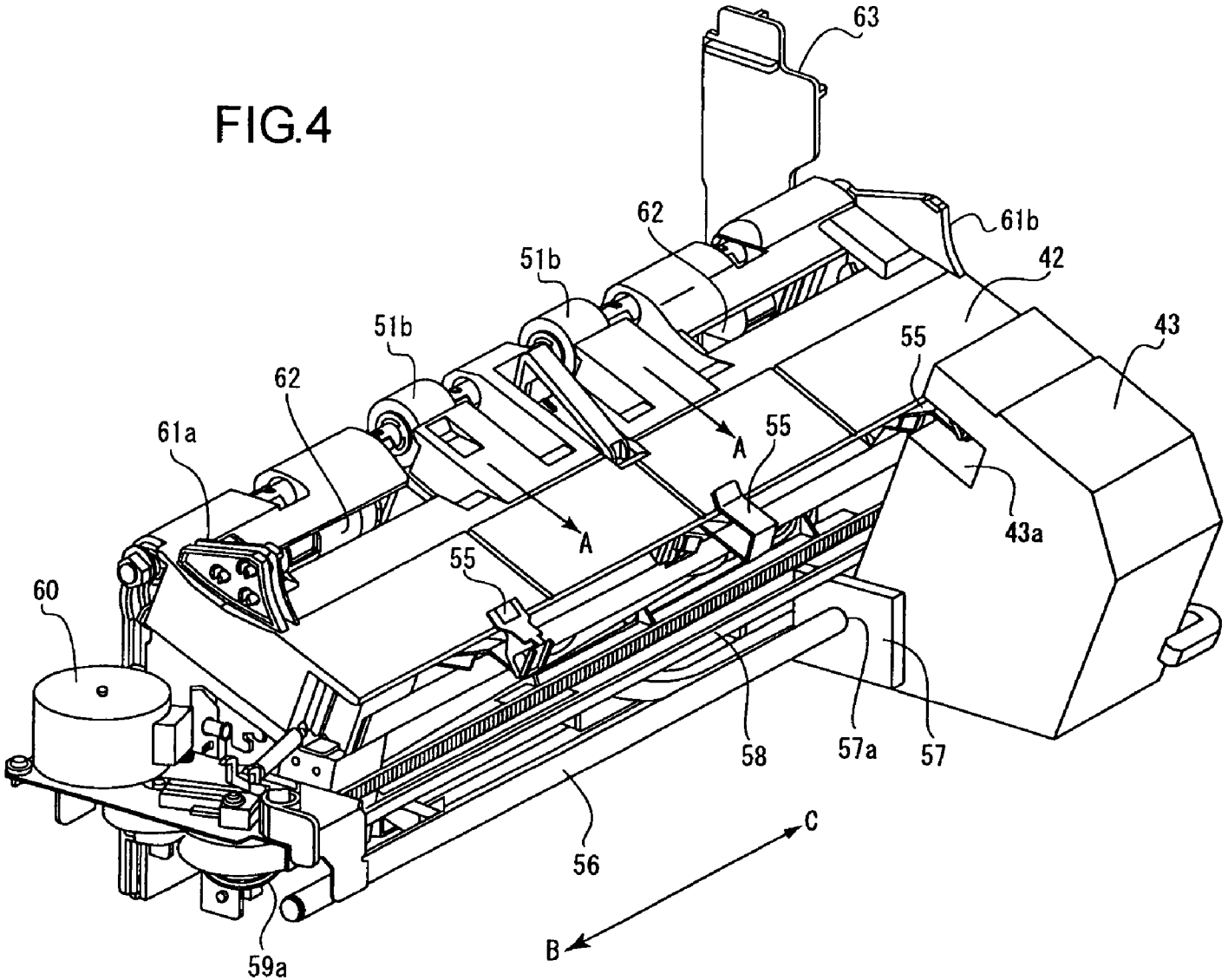
FIG. 4 is a view to explain a positional relationship between the processing tray and post-processing apparatus of the finisher unit of this embodiment.

FIG. 4 is a view to explain a positional relationship between the processing tray 42 and the post-processing apparatus 43 of the finisher unit 4.

As shown in FIG. 4, three positioning members 55 are attached to the lower end portion of the processing tray 42 along the direction (shown by the arrows B and C in the figure) perpendicular to the sheet feeding direction shown by the arrow A. The positioning members 55 are attached to protrude from the front end of the processing tray 42. The post-processing apparatus 43 is disposed so that the storage portion 43*a* accommodates portions corresponding to the positioning members 55. Accordingly, the storage portion 43*a* accommodates the front end portions of the sheets positioned by the positioning members 55.

Described below is a construction of the post-processing apparatus 43. The post-processing apparatus 43 has a stapling mechanism inside the housing. The stapling mechanism is comprised of a head portion and anvil portion. The head portion bends a needle-shaped staple (hereinafter, referred to as a "staple") in the shape of a "U" to strike out, and press-inserts the staple into the sheets on the processing tray 42. The anvil portion receives the front end of the staple struck from the head portion to bend. It is thus configured to perform the binding processing on the sheets on the processing tray 42.

Under the processing tray 42 is disposed a travel shaft 56 of the post-processing apparatus 43 along the direction shown by the arrows B and C in the figure. The travel shaft 56 is fixed at the end portion to the housing (hereinafter, referred to as a "unit frame") of the finisher unit 4, and passed through a fit hole 57*a* formed in a shaft support section 57 fixed to the side portion of the post-processing apparatus 43. Above the travel shaft 56, a timing belt 58 is attached substantially in parallel with the travel shaft 56. The timing belt 58 is laid between pulleys 59*a* and 59*b* (not shown) provided near the end portion of the unit frame, and fixed to the post-processing apparatus 43 at the predetermined position. To the pulley 59*a* is conveyed the revolving force from a unit moving motor 60 via the conveyor gear. By driving the unit moving motor 60 in forward and reverse rotation, the post-processing apparatus 43 is configured to be able to travel along the direction of the arrows B and C in the figure.

L-shaped cross section aligning plates 61*a* and 61*b* are attached on the sheet feeding path in the processing tray 42. A slit groove 62 is formed in the processing tray 42 in the direction perpendicular to the sheet feeding direction, and the aligning plates 61 are attached to the slit groove 62 slidable along the direction of the arrows B and C shown in figure. The aligning plates 61 align the side edge portions of the sheets and move the sheets to a predetermined position on the processing tray 42. It is assumed in the image formation apparatus 1 according to this embodiment that sheets are fed from the image formation unit 2 with reference to a center position in the sheet width direction. Therefore, image-formed sheets with a different width size are stacked on the processing tray 42 with reference to the center position in the sheet width direction.

The finisher unit 4 has side plates 63 fixed to side end portions of the processing tray 42. The side plates 63 are provided to prevent sheets fed on the processing tray 42 from deviating from on the processing tray 42 to be fed. FIG. 4 shows only one of the side plates 63 (at the back in the figure), and the other side plate 63 (at the front side in the figure) is omitted.

Figure 5:
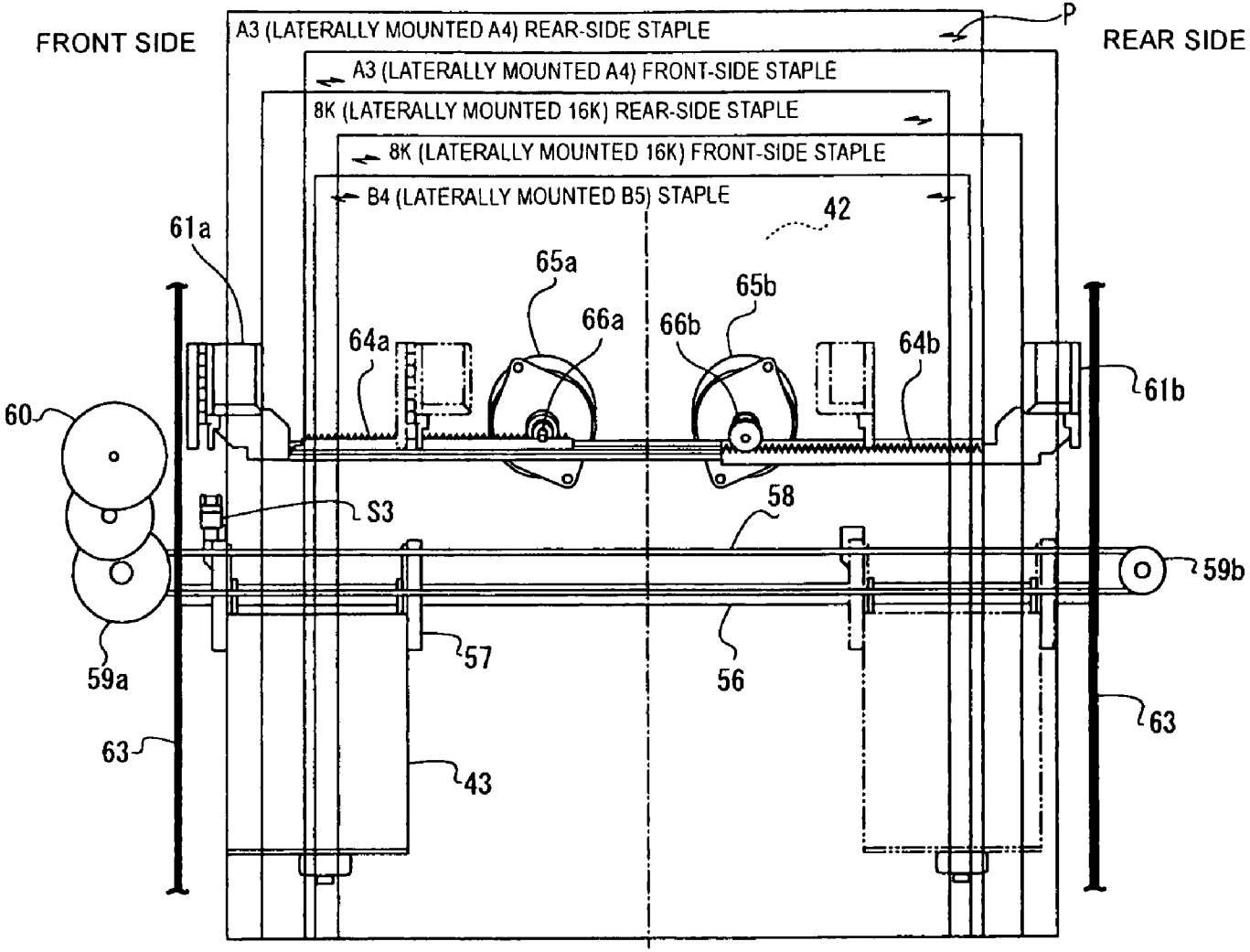
FIG. 5 is an upper view of the processing tray and post-processing apparatus including an internal structure of aligning plates in the finisher unit of this embodiment.

FIG. 5 is an upper view of the processing tray 42 and post-processing apparatus 43 including an internal structure of the aligning plates 61. In addition, FIG. 5 illustrates the relationship between sheets of various sizes targeted for the binding processing and positions on the various sheets undergoing the binding processing. In FIG. 5, for convenience in description, the positions undergoing the binding processing are shown in the upper side.

As shown FIG. 5, each of the aligning plates 61 is provided on the rear side (inner side) of the processing tray 42 with a rack 64 to extend from the leg portion of the L-shaped cross section. An aligning motor 65 is disposed near the rack 64. In the rack 64 is engaged a pinion gear 66 installed in the driving axis of the aligning motor 65. A well-known reduction mechanism is provided between the aligning motor 65 and pinion gear 66.

Aligning motors 65*a* and 65*b* (hereinafter, the aligning motor 65*a* is referred to as a "first aligning motor 65*a*", and the aligning motor 65*b* is referred to as a "second aligning motor 65*b*" as appropriate) are each comprised of a stepping motor, for example, and cause aligning plates 61*a* and 61*b* to come close or away by the same amount by receiving supply of predetermined power supply pulses. Near the aligning plates 61*a* and 61*b* are provided position sensors S2 (not shown) that detect positions of the aligning plates 61*a* and 61*b*, respectively, and home positions are set at solid-line positions shown in FIG. 5. The aligning plates 61*a* and 61*b* are configured to travel to standby positions corresponding to the sheet size when power supply pulses corresponding to the sheet size notified from the image formation unit 2 are supplied to the aligning motors 65*a* and 65*b*, and align widths of sheets fed on the processing tray 42 to neatly position on a center basis. Hereinafter, the position of sheets positioned on a center basis is referred to as a "center position".

A position sensor S3 that detects a position of the post-processing apparatus 43 is provided at one end portion of the shaft support section 57 fixed to the post-processing apparatus 43, and a home position is set at the solid-line position as shown in FIG. 5. A position sensor 67 is comprised of an actuator provided on the post-processing apparatus 43 side and a photosensor provided on the unit frame side, for example. The apparatus 43 is configured to first travel to a predetermined standby position (center position in the sheet width direction) when power supply pulses corresponding to the sheet size notified from the image formation unit 2 are supplied to the unit moving motor 60, and then travel to a post-processing position corresponding to the sheet size after sheets are fed on the processing tray 42.

In order to reduce a travel amount of the post-processing apparatus 43 in performing the binding processing at different positions of sheets by the post-processing apparatus 43, the finisher unit 4 according to the invention is configured to move the post-processing apparatus 43, while moving sheets on the processing tray 42 substantially in parallel with the travel direction of the post-processing apparatus 43.

In particular, the finisher unit 4 determines whether to move only the post-processing apparatus 43 or move both the post-processing apparatus 43 and sheets in response to the size of fed sheets. In other words, the finisher unit 4 moves only the post-processing apparatus 43 for sheets with a size less than a predetermined width, while moving the post-processing apparatus 43 and sheets of such a size or more. More specifically, the finisher unit 4 is configured to move only the post-processing apparatus 43 for sheets with a size (for example, B4 and A4) less than 8K size of sheet size in China, while moving the post-processing apparatus 43 and sheets (for example, 8K and A3) more than or equal to 8K size.

FIG. 5 shows only B4-size, 8K-size and A3-size sheets. In addition, without specifying particularly, the figure is assumed to show sheets fed in the longitudinal direction of the sheet size. Further, in the figure, the left side indicates a "front side", while the right side indicates a "rear side", and a staple is shown by "P".

In the finisher unit 4, when performing the binding processing on B4-size sheets, only the post-processing apparatus 43 is moved, and the post-processing is performed at a predetermined position of sheets without moving the sheets. Therefore, in performing the binding processing on the front side or rear side, the position of the B4-size sheets is the same.

Meanwhile, in performing the binding processing on 8K-size sheets, the sheets are moved, as well as the post-processing apparatus 43. In other words, in performing the binding processing on the front side of 8K-size sheets, the post-processing apparatus 43 is moved from the standby position (center position in the sheet width direction) to the front side (to the left), while the sheets are moved from the center position to the rear side (to the right). Meanwhile, in performing the binding processing on the rear side, the post-processing apparatus 43 is moved from the standby position to the rear side (to the right), while the sheets are moved from the center position to the front side (to the left). Therefore, when the binding processing is performed on the front side or rear side, 8K-size sheets are in different positions. In addition, A3-size sheets are the same as in 8K-size sheets.

Figure 6:
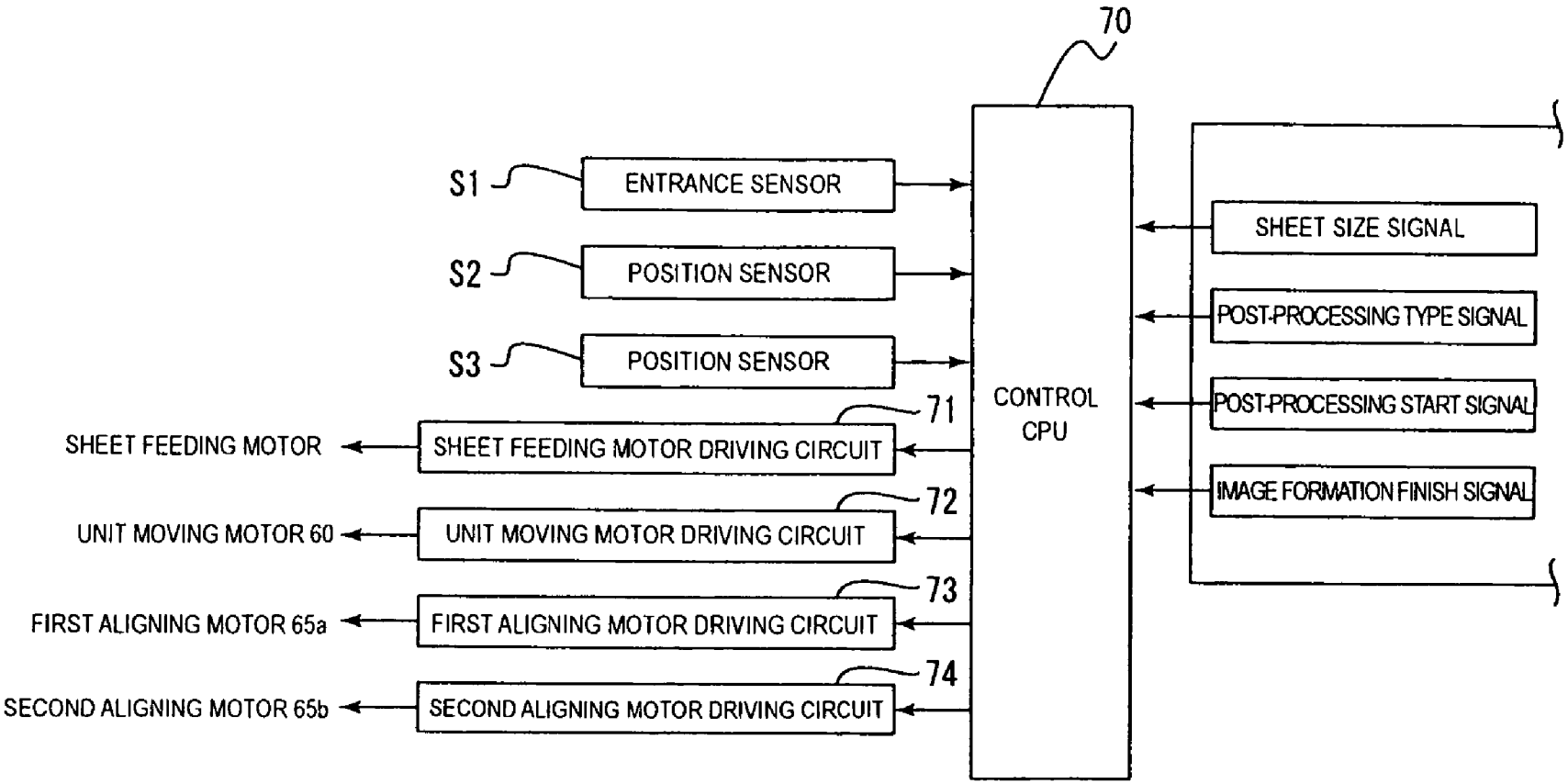
FIG. 6 is a block diagram showing structural elements associated with control of binding processing performed in the finisher unit of this embodiment.

Referring to FIG. 6, described below are structural elements associated with control of the binding processing performed in the finisher unit 4 of this embodiment. FIG. 6 is a block diagram showing structural elements associated with control of the binding processing performed in the finisher unit 4.

A control CPU 70 is to control the entire image formation apparatus 1 including the finisher unit 4. In executing the control, the CPU 70 reads a control program from ROM not shown, and uses RAM not shown as a work area. FIG. 6 particularly shows the structural elements associated with the binding processing performed in the finisher unit 4, and omits the other structure.

The control CPU 70 receives various signals necessary to execute the binding processing from the image formation unit 2. More specifically, input to the CPU 70 are a signal (sheet size signal) indicative of a size of sheets to feed, a signal (post-processing type signal) indicative of a type of post-processing for the finisher 4 to execute, a signal (post-processing start signal) to instruct to start the post-processing, and a signal (image formation finish signal) indicative of finish of image formation on the sheets.

The control CPU 70 is connected to various sensors, and receives a signal of each of the sensors. More specifically, input to the CPU 70 are a signal of detecting a front end (hereinafter, referred to as a "sheet front end detection signal") or rear end (hereinafter, referred to as a "sheet rear end detection signal") of a sheet from the entrance sensor S1, signals of detecting positions of the aligning plates 61 from the position sensors S2, and a signal of detecting a position of the post-processing apparatus 43 from the position sensor S3.

Further, the control CPU 70 is connected to various motor driving circuits. More specifically, to the CPU 70 are connected a sheet feeding motor driving circuit 71 that controls driving of the sheet feeding motor that applies driving force to the feeding rollers 46,47 and ejecting roller 51*a*, a unit moving motor driving circuit 72 that controls driving of the unit moving motor 60, a first aligning motor driving circuit 73 that controls driving of the first aligning motor 65*a*, and a second aligning motor driving circuit 74 that controls driving of the second aligning motor 65*b*. The control CPU 70 outputs control signals to the motor driving circuits based on various signals received from the image formation unit 2 and various sensor signals input from the various sensors.

Referring to FIG. 5, described below is the operation when the finisher unit 4 performs the post-processing (binding processing) in the image formation apparatus 1 with the above-mentioned construction. In addition, it is assumed in following descriptions that A3-size sheets are fed as binding-processing target sheets (A3 (laterally mounted A4) as shown in FIG. 5), and that the binding processing by the post-processing apparatus 43 is performed first on the front side and then on the rear side as shown in FIG. 5. In addition, the order of the binding processing is not limited thereto.

When a user of the image formation apparatus 1 mounts an original with a plurality of pages on the original mount 22, for example, and instructs image formation processing (copy processing), the image formation unit 2 inputs a sheet size signal of the original targeted for the processing and post-processing type signal to the control CPU 70. In addition, it is assumed herein that a binding processing signal is input as the post-processing type signal and instructs the binding processing at different two end portions of sheets.

Upon receiving the sheet size signal, the control CPU 70 drives the first aligning motor 65*a* and second aligning motor 65*b* via the first aligning motor driving circuit 75*a* and second aligning motor driving circuit 75*b*. At this point, the control CPU 70 supplies power supply pulses corresponding to the sheet size to the first aligning motor 65*a* and second aligning motor 65*b*. The aligning plates 61*a* and 61*b* thereby travel to standby positions the distance between which is slightly larger than the sheet width (of the shorter side of the A3-size sheet). In addition, before moving the aligning plates 61*a* and 61*b* to the standby positions, the plates are placed at the home positions shown by the solid-line position in FIG. 5.

When the image formation processing is finished in the printing section 7, the image formation unit 2 inputs an image formation finish signal to the control CPU 70. Upon receiving the image formation finish signal, the control CPU 70 drives the sheet feeding motor via the sheet feeding motor driving circuit 71. By this means, the feeding rollers 46, 47 and ejecting roller 51*a* rotate in the finisher unit 4. Then, a sheet fed in the finisher unit 4 is fed on the feeding path 45 by the feeding rollers 46 and 47.

When the fed sheet is passed by the entrance sensor S1 formed on the feeding path 45, the entrance sensor S1 inputs a sheet rear end detection signal to the control CPU 70. Upon receiving the sheet rear end detection signal, the control CPU 70 calculates the estimate time lapsed until the sheet is ejected to the processing tray 42 and then reaches the positioning members 55. Then, after a lapse of the estimate time, the control CPU 70 drives the first aligning motor 65*a* and second aligning motor 65*b*. At this point, the control CPU 70 supplies the power supply pulses to the first aligning motor 65*a* and second aligning motor 65*b* such that the aligning plates 61*a* and 61*b* reciprocate between respective standby positions and positions corresponding to the sheet size. The sheet ejected onto the processing tray 42 is thereby aligned in width and moved to the center position by the aligning plates 61*a* and 61*b*.

By repeating the aforementioned processing, sheets are mounted on the processing tray 42 and a bundle of sheets is formed. Then, when the image formation processing is finished on the last page of the original instructed from the user during the time the above-mentioned processing is repeated, the image formation unit 2 inputs a post-processing start signal to the control CPU 70. Upon receiving the post-processing start signal, the control CPU 70 drives the unit moving motor 60 via the unit moving motor driving circuit 72. At this point, the control CPU 70 supplies power supply pulses to the unit moving motor 60 such that the post-processing apparatus 70 travels to the standby position. The post-processing apparatus 43 thereby travels to the standby position (center position in the sheet width direction) from the home position.

When a sheet of the last page to feed is passed by the entrance sensor S1 formed on the feeding path 45, the entrance sensor S1 inputs a sheet rear end detection signal in response to the last page to the control CPU 70. Upon receiving the sheet rear end detection signal in response to the last page, the control CPU 70 calculates the estimate time lapsed until the sheet is ejected to the processing tray 42 and then reaches the positioning members 55. After a lapse of the estimate time, the control CPU 70 drives the unit moving motor 60, concurrently with driving the first aligning motor 65*a* and second aligning motor 65*b*. In addition, the control CPU 70 stops driving of the sheet feeding motor corresponding to a lapse of the estimate time.

At this point, the control CPU 70 supplies power supply pulses to the first aligning motor 65*a* and second aligning motor 65*b* such that a bundle of sheets on the processing tray 42 is shifted to a predetermined position on the rear side from the center position, concurrently with supplying power supply pulses to the unit moving motor 60 such that the post-processing apparatus 43 travels to a predetermined position on the front side. By this means, the post-processing apparatus 43 travels to the post-processing position set to perform the binding processing on the front side of the A3-size sheet, while the bundle of sheets is shifted to the post-processing undergoing position in response to the post-processing position. Then, when moving of the post-processing apparatus 43 and the bundle of sheets is finished, a staple is struck, and the binding processing is executed on the front side of the A3-size sheets.

After executing the binding processing on the front side of the A3-size sheets, control CPU 70 supplies power supply pulses to the first aligning motor 65*a* and second aligning motor 65*b* such that a bundle of sheets on the processing tray 42 is shifted to a predetermined position on the front side from the center position, concurrently with supplying power supply pulses to the unit moving motor 60 such that the post-processing apparatus 43 travels to a predetermined position on the rear side. By this means, the post-processing apparatus 43 travels to the post-processing position set to perform the binding processing on the rear side of the A3-size sheets, while the bundle of sheets is shifted to the post-processing undergoing position in response to the post-processing position. Then, when moving of the post-processing apparatus 43 and the bundle of sheets is finished, a staple is struck, and the binding processing is executed on the rear side of the A3-size sheets.

When the binding processing on the front side and rear side of the sheets is thus finished, the control CPU 70 moves the sheet ejecting mechanism 54 downward by a driving motor not shown, and brings the ejecting roller 51*a* into contact with the bundle of sheets. Then, the control CPU 70 drives the sheet feeding motor via the sheet feeding motor driving circuit 70. The ejecting roller 51*a* is thereby rotated and ejects the bundle of sheets on the processing tray 42 to the collection tray 44. Thus, the finisher unit 4 completes a series of operation in performing the post-processing (binding processing).

In addition, described herein is the case of driving the first aligning motor 65*a* and second aligning motor 65*b* such that the aligning plates 61*a* and 61*b* reciprocate between respective standby positions and positions corresponding to the sheet size, whenever receiving the sheet rear end detection signal. However, the first aligning motor 65*a* and second aligning motor 65*b* may be driven such that the aligning plates 61*a* and 61*b* reciprocate between respective standby positions and positions corresponding to the sheet size when a predetermined number of sheets are ejected on the processing tray 42. It this case, as compared with the case of performing the binding processing after the aligning operation is performed whenever a sheet is ejected to the processing tray 42, it is possible to hasten the timing for shifting to the binding processing, and to perform the post-processing efficiently. In addition, for example, detecting whether a predetermined number of sheets are ejected on the processing tray 42 can be implemented by counting the sheet rear end detection signal input from the entrance sensor S1.

Figure 7:
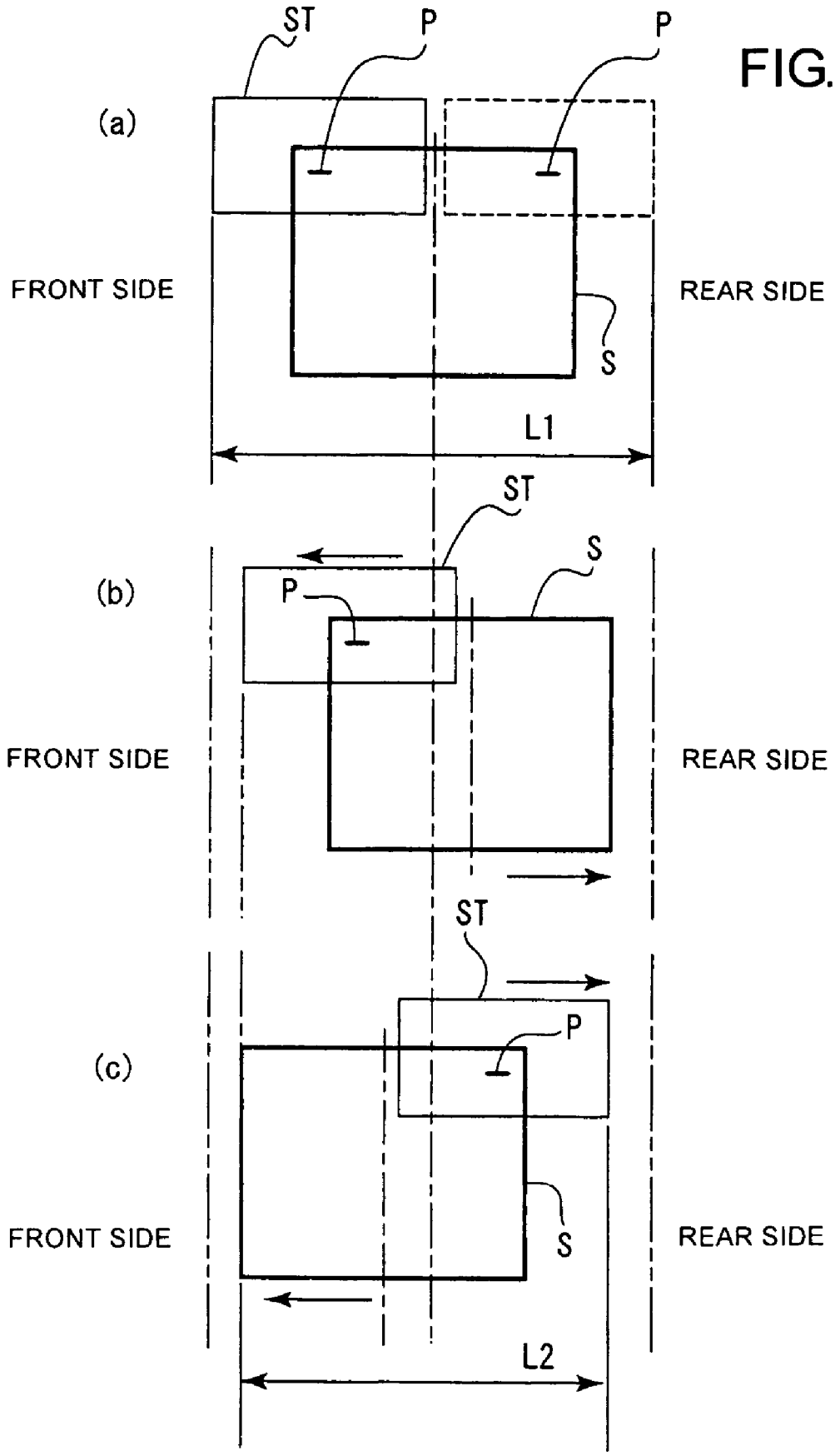
FIG. 7 is a schematic diagram to explain the effect obtained by the finisher unit of this embodiment.

FIG. 7 is a schematic diagram to explain the effect obtained by the finisher unit 4 according to this embodiment. In addition, FIG. 7 shows the relationship between the post-processing apparatus and sheets targeted for the binding processing. FIG. 7(*a*) shows the relationship between the conventional post-processing apparatus and sheets. FIGS. 7(*b*) and (c) show the relationship between the post-processing apparatus of the finisher unit 4 according to this embodiment and sheets. In FIG. 7, for convenience in description, "ST" represents the post-processing apparatus, and "S" represents sheets. Further, in FIG. 7, the left side is assumed the front side, the right side is assumed the rear side, and "P" represents a staple.

As shown in FIG. 7(*a*), in the case of performing the binding processing at different corner portions of the sheets S, the post-processing apparatus ST travels in the horizontal direction as viewed in the figure. The sheets S are not shifted in the conventional apparatus, and the space required to execute the post-processing is only dependent on a travel range of the post-processing apparatus ST. In this case, the post-processing apparatus ST itself has a predetermined width, and therefore, it is required to reserve a width (indicated by "L" shown in FIG. 7(*a*)) corresponding to a travel range of the post-processing apparatus ST, for the space necessary to execute the post-processing.

In contrast thereto, in the finisher unit 4 according to this embodiment, moved are not only the post-processing apparatus ST, but also the sheets S. In addition, in a standby state before executing the post-processing, as described above, the post-processing apparatus ST and sheets S are both placed at the center position in the sheet width direction. In the case of executing the binding processing on the front side of the sheets S, as shown in FIG. 7(*b*), the post-processing apparatus ST is moved to the front side, while the sheets S are moved to the rear side, and the binding processing is performed. Meanwhile, in the case of executing the binding processing on the rear side of the sheets S, as shown in FIG. 7(*c*), the post-processing apparatus ST is moved to the rear side, while the sheets S are moved to the front side, and the binding processing is performed. Therefore, a travel distance of the post-processing apparatus ST can be reduced by a shift distance of the sheets S, and it is thus possible to reduce the space necessary to execute the post-processing to the width indicated by "L2" as shown in FIG. 7(*c*).

Thus, the finisher unit 4 according to this embodiment is configured to move only the post-processing apparatus 43 in executing the binding processing on sheets with a size less than a predetermined sheet size, while moving both the post-processing apparatus 43 and sheets in executing the binding processing on the sheets with a size more than or equal to the predetermined sheet size. In such a constitution, whether or not to shift sheets is dependent on the sheet size and dimensions of the post-processing apparatus 43. Further, in the case of shifting sheets, an amount (range) of shift of the sheets is dependent on the distance between the side plates 63, in addition to the sheet size and dimensions of the post-processing apparatus 43.

Figure 8:
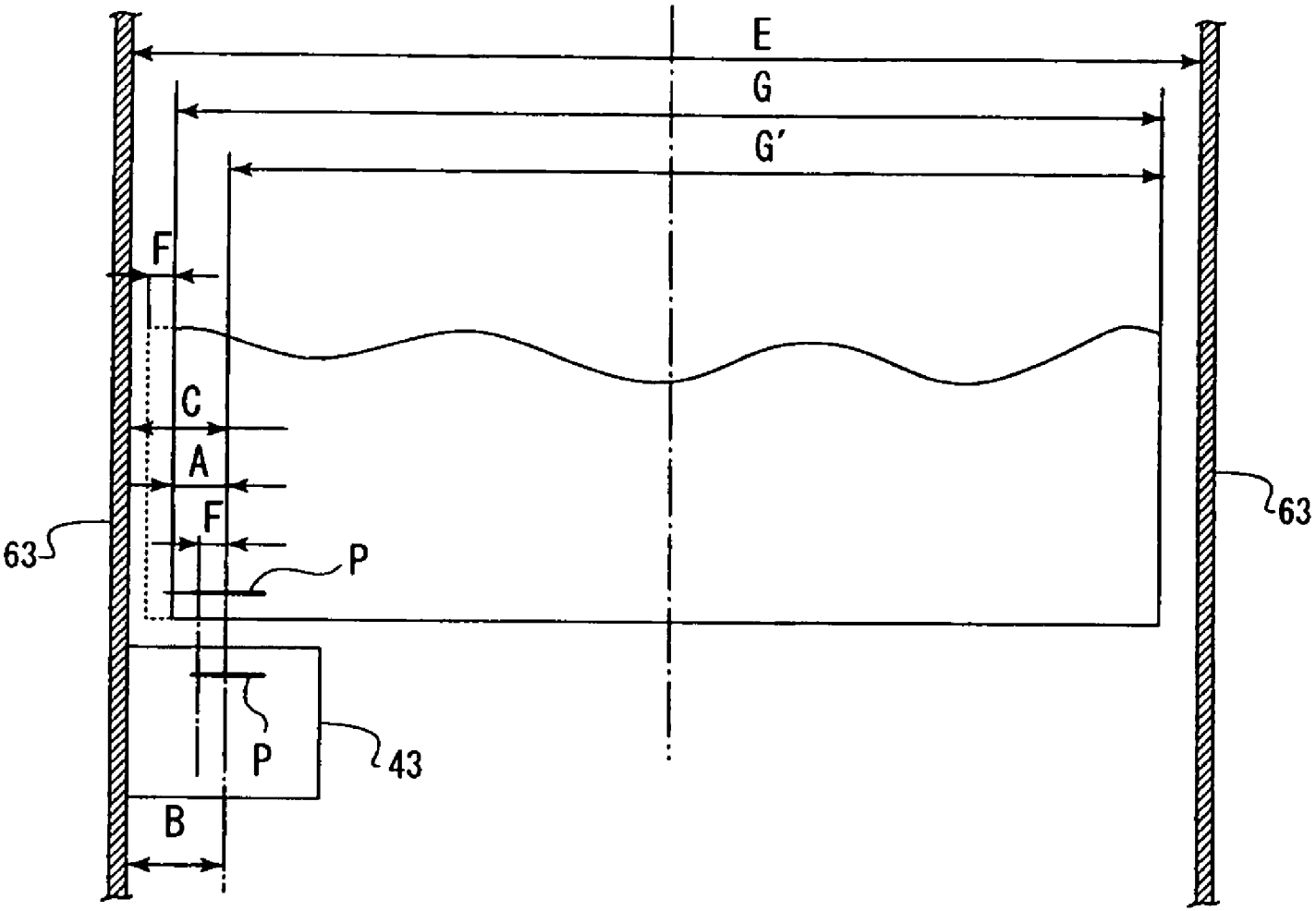
FIG. 8 is a diagram to explain on whether to need to shift sheets and an amount of shift when the sheets are shifted in the finisher unit of this embodiment.

FIG. 8 is a diagram to explain on whether or not to need to shift sheets and an amount (range) of shift when the sheets are shifted in the finisher unit 4 of this embodiment. In addition, FIG. 8 shows the case where the post-processing apparatus 43 is placed in the position to execute the binding processing at one end portion (on the front side) of processing-target sheets.

It is assumed in FIG. 8 that "A" is a distance from the end portion of sheets targeted for the binding processing to the center position of the staple P, "B" is a distance from the center position of the staple P to the end portion of the post-processing apparatus 43, "C" is a distance from the side plate 63 to the center position of the staple P subjected to the binding processing on the sheets, "E" is a distance between the side plates 63 on the front side and rear side, "F" is an amount of shift of sheets, "G" is a sheet size, and "G'" is a distance from the feeding-direction front end of the sheets to the center position of the staple P.

In the figure, it is further assumed that the sheets are moved between the side plate 63 on the front side and the slide plate 63 on the rear side (strictly, a distance between respective inward positions from the side plates 63 by a thickness of the aligning plate 61). Furthermore, in the case of shifting sheets, it is assumed that in performing the binding processing on the front side, the sheets are moved to the opposite side i.e. rear side, while in performing the binding processing on the rear side, the sheets are moved to the opposite side i.e. front side. FIG. 8 shows the case where the binding processing is performed on the front side, and the sheets are moved from the position of dotted-line portion and arrive at the position of solid-line portion on the rear side. While the post-processing apparatus 43 is brought into intimate contact with the side plate 63, a clearance margin between 4.5 mm to 7.5 mm may be provided between the post-processing apparatus 43 and side plate 63. In this case, the "C" is replaced with a distance from the end portion of the post-processing apparatus 43 to the center position of the staple P subjected to the binding processing on the sheets.

Whether or not to need to shift the sheets is determined corresponding to sizes of "C" and "B". In other words, when $C \geqq B$, it is possible to respond to the processing by only moving the post-processing apparatus 43, and it is not necessary to shift the sheets. In contrast thereto, when $C<B$, it is not possible to respond to the processing by only moving the post-processing apparatus 43, and the need arises of shifting the sheets.

Further, in the case of shifting sheets, with respect to an amount (range) of shift (F) of the sheets, the following relationship holds:

$$B-C \leqq F \leqq E-\{(G-A)+B\}=E-(G'+B)$$

By shifting the sheets in such a range, it is possible to perform the binding processing suitably corresponding to the size of sheets targeted for the binding processing and the like.

As described above, according to the image formation apparatus 1 incorporating the finisher unit 4 according to this embodiment, in order to enable the binding processing to be performed at different binding-processing target positions of sheets, the post-processing apparatus 43 is moved to a plurality of post-processing positions, while the sheets are moved to post-processing undergoing positions in response to the post-processing positions, thereby enabling decreases in the amount of travel of the post-processing apparatus 43. Since the range of travel of the post-processing apparatus 43 can thereby be reduced, it is made possible to implement the finisher unit 4 compact in size while performing the binding processing appropriately on sheets ejected from the image formation unit 2.

In the above-mentioned constitution, a plurality of post-processing undergoing positions set to perform the binding processing at different positions of sheets are set corresponding to the size of the sheets, and it is thus possible to perform the binding processing suitably corresponding to the size of sheets with images formed thereon by the image formation unit 2.

Further, in the above-mentioned constitution, corresponding to the size of sheets targeted for the binding processing, it is determined whether to move only the post-processing apparatus 43 or move both the post-processing apparatus 43 and the sheets, and it is thus made possible to move only sheets of specific size. By this means, the operation of the aligning plates 61 to shift the sheets can be limited to the specific case, and it is thus possible to prevent the control from becoming complicated. For example, in the above-mentioned constitution, since sheets with sizes more than or equal to a predetermined size (8K size in the foregoing) are moving-target sheets, it is possible to perform the post-processing on sheets with sizes (for example, B4 size) less than the predetermined size without complicating the control.

Furthermore, in the above-mentioned constitution, sizes of shift-target sheets are set at values such that the binding processing cannot be performed at the binding processing target position on the sheets even when the post-processing 43 travels to the limit position in the travel-capable range. It is thereby possible to minimize the types of sheets necessary to shift sheets in performing the binding processing.

In particular, in the above-mentioned constitution, sheets are moved in the direction opposite to the direction in which the travel of the post-processing apparatus 43 is limited. By this means, the amount of travel of the post-processing 43 can be decreased reliably, thereby enabling reduction in the range of travel of the post-processing apparatus 43, and it is thus possible to implement the finisher unit 4 compact in size.

Moreover, the case is described in the above-mentioned constitution that sheets on the processing tray 42 are moved by the aligning means including the aligning plates 61 in parallel with the travel direction of the post-processing apparatus 43. However, the invention is not limited thereto, and sheet moving means for shifting sheets on the processing tray 42 may be provided separately. As in the above-mentioned embodiment, in the case of using the aligning means including the aligning plates 61 also as the sheet moving means, it is possible to reduce the number of parts of the finisher unit 4, and to implement a further compact finisher unit.

In addition, in the above-mentioned finisher unit 4, sheets fed from the image formation unit 2 are aligned in the center position by the aligning plates 61, while the standby position of the post-processing apparatus 43 is set at the center position in the sheet width direction. However, the aligning position of sheets by the aligning plates 61 and/or the standby position of the post-processing apparatus 43 can be set arbitrarily. For example, the standby position of the post-processing apparatus 43 can be set at a position corresponding to the binding processing.

Figure 9:
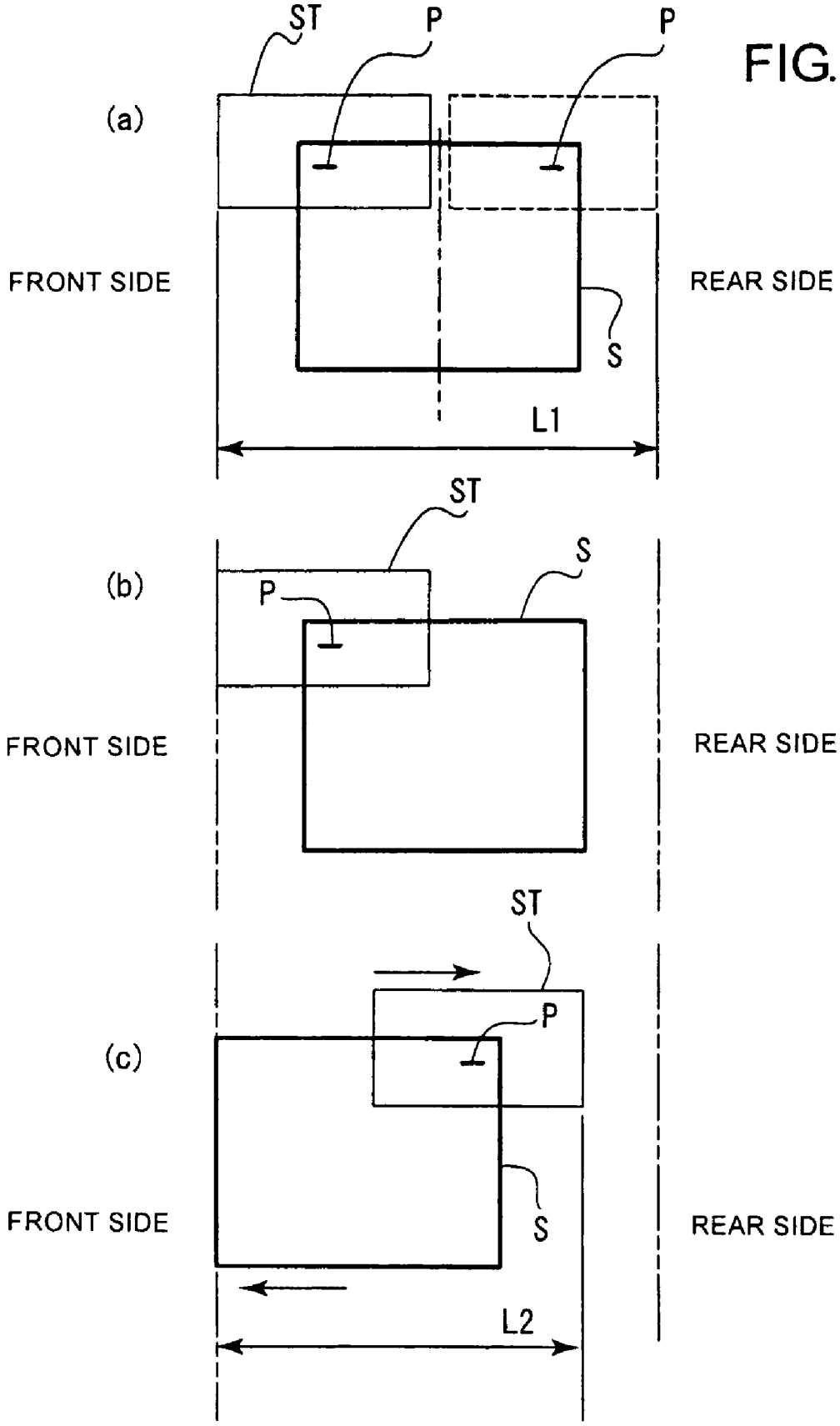
FIG. 9 is a schematic diagram to explain the effect obtained in setting a standby position of the post-processing apparatus at a position corresponding to the binding processing in the finisher unit of this embodiment.
Figure 10:
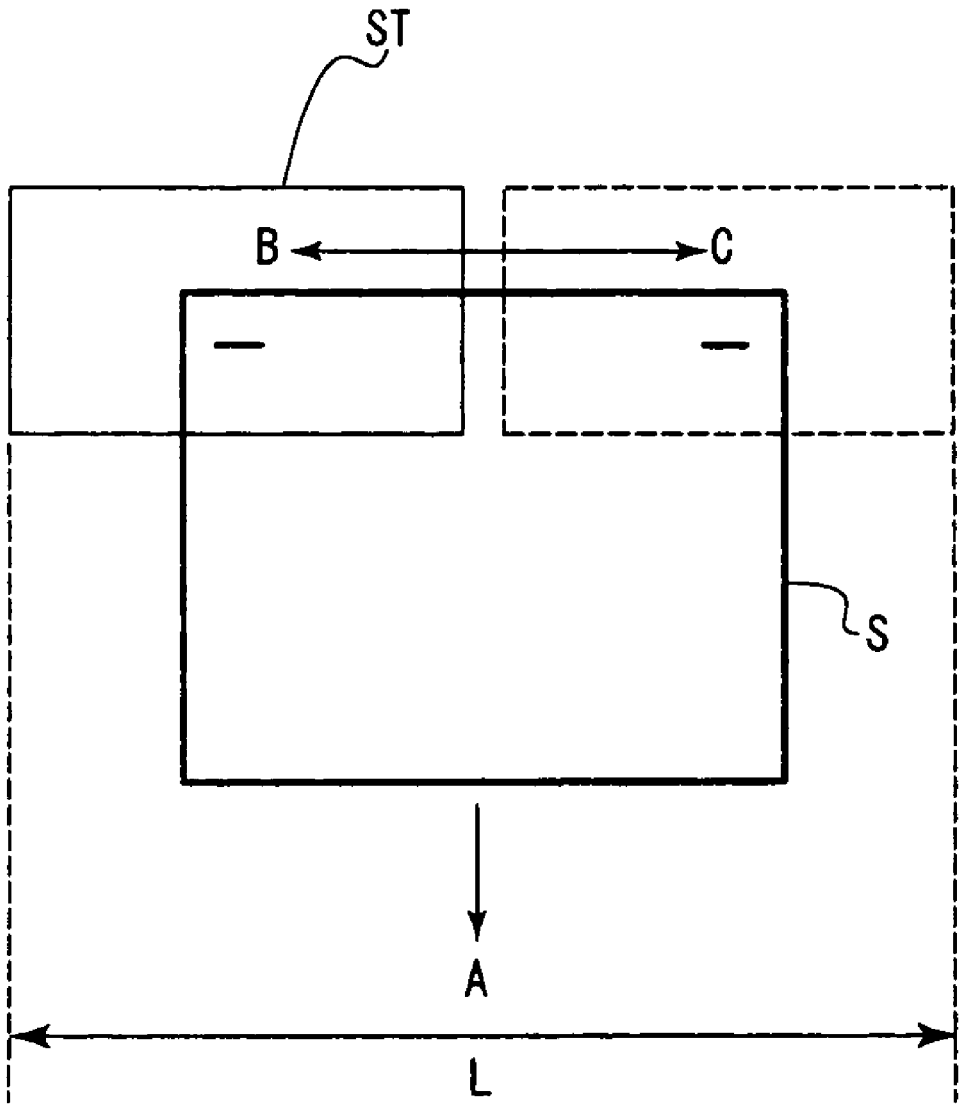
FIG. 10 Prior Art
FIG. 10 is a schematic diagram illustrating the case where a conventional stapler performs the binding processing.

FIG. 9 is a diagram to explain the effect obtained in setting the standby position of the post-processing apparatus 43 at a position corresponding to the binding processing in the finisher unit 4. FIG. 9 shows the relationship between the post-processing apparatus and sheets targeted for the binding processing. FIG. 9(*a*) is the same as FIG. 7(*a*), and descriptions thereof are omitted. In FIG. 9, descriptions are omitted on elements with the same reference numerals as in FIG. 7.

In FIG. 9(*b*), the standby position of the post-processing apparatus ST is set at a stop position (post-processing position) when the binding processing is performed on the front side. In addition, the aligning position of sheets S by the aligning plates 61 is set at the center position in the sheet width direction as in FIG. 7(*b*). In the case of performing the binding processing on the front side of the sheets S, the binding processing is executed at such positions without moving the post-processing apparatus ST and sheets S. Meanwhile, in the case of performing the binding processing on the rear side of the sheets S, as shown in FIG. 9(*c*), the post-processing apparatus ST is moved to the rear side, while the sheets S are moved to the front side, and the binding processing is executed. Therefore, the travel distance of the post-processing apparatus ST can be reduced by the shift distance of the sheets S, and it is thus possible to reduce the space necessary to execute the post-processing to the width indicated by "L2" shown in FIG. 9(*c*).

Particularly, in the case of thus setting the standby position of the post-processing apparatus ST, the need is eliminated of moving the post-processing apparatus ST in performing the binding processing on the front side, and it is thereby possible to shorten the time required for the binding processing.

In addition, the above-mentioned embodiment describes the case where the binding processing is performed on the end portion of sheets mounted on the processing tray 42. However, the finisher unit 4 according to the present invention is not limited thereto, and is applicable to other cases of performing center-binding processing on near the center of sheets mounted on the processing tray 42, or on near the center of sheets fed from the processing tray 42. For example, such processing can be implemented by providing separately feeding means for feeding sheets on the processing tray 42, and disposing the post-processing apparatus 43 on the feeding means, while shifting the sheets by the aligning plates 61 in the direction perpendicular to the feeding direction of the feeding means.

Further, described in the foregoing is the case where the finisher unit 4 as the sheet post-processing apparatus is incorporated into the image formation apparatus 1. However, the invention is not limited to such a case, and is naturally applicable to a sheet post-processing apparatus to be attached as a separate unit to an image formation apparatus that performs only the image formation processing.

INDUSTRIAL APPLICABILITY

The present invention is aimed at enabling the binding processing to be performed at different positions of sheets, moving the post-processing means to a plurality of post-processing positions, while moving the sheets to post-processing undergoing positions in response to the post-processing positions, thereby decreasing the range of travel of the post-processing means, and implementing a compact sheet post-processing apparatus, and has industrial applicability.

What is claimed is:

1. A sheet post-processing apparatus comprising:

a mount section to mount sheets ejected from an image formation section;

an aligning section that aligns side-end portions of a sheet ejected on the mount section and moves a bundle of the sheets to post-processing undergoing positions and wherein the aligning section determines whether or not to move the sheets corresponding to a size of the sheets;

a post-processing section that performs binding processing on the bundle of the sheets, aligned by the aligning section, mounted on the mount section, wherein the post- processing undergoing positions are substantially parallel to a travel direction of the post-processing section;

a moving section that moves the post-processing section to a plurality of post-processing positions set corresponding to a size of the sheets to perform the binding processing at different binding processing target positions on the bundle of the sheets; and a control unit that operates to cause the moving section to move the post-processing section during the binding processing in a direction opposite to any of the directions in which the control unit operates the aligning section to move the bundle of sheets to the plurality of post-processing positions;

wherein the post-processing section has a single stapler which performs the binding processing on the bundle of sheets.

2. The sheet post-processing apparatus according to claim 1, wherein the aligning section sets sheets with a size more than or equal to a predetermined size as shift target sheets.

3. The sheet post-processing apparatus according to claim 2, wherein the shift target sheets have a size such that the binding processing is not performed at the binding processing target positions on the sheets even when the post-processing section travels to a limit position in a travel-capable range.

4. The sheet post-processing apparatus according to claim 1, wherein an amount of shift of the sheets by the aligning section is set corresponding to a size of the sheets, dimensions of the post-processing section and a travel-capable range of the post-processing section.

5. The sheet post-processing apparatus according to claim 4, further comprising:

a detecting section that detects that a predetermined number of sheets are ejected on the mount section, wherein the aligning section moves the bundle of the sheets to a predetermined post-processing undergoing position whenever the detecting section detects ejection of the predetermined number of sheets.

6. An image formation apparatus comprising:

an image formation section that forms an image on a sheet;

an ejecting section that ejects the sheet with the image formed thereon; and the sheet post-processing apparatus according to claim 1.

7. A sheet post-processing apparatus comprising:

a mount section to mount sheets ejected from an image formation section;

an aligning section that aligns side-end portions of a sheet ejected on the mount section and moves the bundle of the sheets to post-processing undergoing positions and wherein the aligning section determines whether or not to move the sheets corresponding to a size of the sheets;

a sheet feeding section that feeds downstream a bundle of the sheets, aligned by the aligning section, on the mount section;

a post-processing section which has a head portion that strikes a staple, an anvil portion that is disposed opposite to the head portion and that receives the staple struck from the head portion to bend, and a feeding path provided between the head portion and the anvil portion to pass the bundle of the sheets, and which performs center-binding processing on the bundle of the sheets fed on the feeding path by the sheet feeding section, wherein the post-processing undergoing positions are substantially parallel to a travel direction of the post-processing section;

a moving section that moves the post-processing section to a plurality of post-processing positions set corresponding to a size of the sheets to perform the binding processing at different binding processing target positions on the bundle of the sheets in the direction perpendicular to a feeding direction by the sheet feeding section; and a control unit that operates to cause the moving section to move the post-processing section during the binding processing in a direction opposite to any of the directions in which the control unit operates the aligning section to move the bundle of sheets to the plurality of post-processing positions;

wherein the post-processing section has a single stapler which performs the binding processing on the bundle of sheets.

8. The sheet post-processing apparatus according to claim 7, wherein the aligning section sets sheets with a size more than or equal to a predetermined size as shift target sheets.

9. The sheet post-processing apparatus according to claim 8, wherein the shift target sheets have a size such that the binding processing is not performed at the binding processing target positions on the sheets even when the post-processing section travels to a limit position in a travel-capable range.

10. The sheet post-processing apparatus according to claim 7, wherein an amount of shift of the sheets by the aligning section is set corresponding to a size of the sheets, dimensions of the post-processing section and a travel-capable range of the post-processing section.

11. The sheet post-processing apparatus according to claim 10, further comprising:

a detecting section that detects that a predetermined number of sheets are ejected on the mount section, wherein the aligning section moves the bundle of the sheets to a predetermined post-processing undergoing position whenever the detecting section detects ejection of the predetermined number of sheets.

12. An image formation apparatus comprising:

an image formation section that forms an image on a sheet;

an ejecting section that ejects the sheet with the image formed thereon; and the sheet post-processing apparatus according to claim 7.

* * * * *